US005542469A

United States Patent [19]

Kim

[11] Patent Number: 5,542,469

[45] Date of Patent: Aug. 6, 1996

[54] INDOOR UNIT OF AIR CONDITIONER

[75] Inventor: Dong-Wug Kim, Seoul, Rep. of Korea

[73] Assignee: Samsung Electronics Co., Ltd., Suwon, Rep. of Korea

[21] Appl. No.: 293,951

[22] Filed: Aug. 24, 1994

[30] Foreign Application Priority Data

Aug. 25, 1993 [KR] Rep. of Korea ..... 93-16564

[51] Int. Cl.[6] ..... F28F 13/12

[52] U.S. Cl. ..... 165/122; 165/53; 165/54

[58] Field of Search ..... 165/122, 53, 54; 62/263

[56] References Cited

U.S. PATENT DOCUMENTS

| | | | |
|---|---|---|---|
| 2,724,578 | 11/1955 | Swank | 165/54 X |
| 3,519,069 | 7/1970 | Green | 165/122 |
| 5,188,169 | 2/1993 | Lim | 165/122 X |

FOREIGN PATENT DOCUMENTS

| | | | |
|---|---|---|---|
| 55627 | 4/1983 | Japan | 165/54 |
| 1936 | 1/1986 | Japan | 165/124 |
| 27771 | 7/1987 | Japan . | |
| 123938 | 5/1989 | Japan | 165/53 |
| 181722 | 8/1991 | Japan | 165/53 |
| 241244 | 10/1991 | Japan | 165/53 |
| 158130 | 6/1992 | Japan | 165/53 |
| 699294 | 11/1979 | U.S.S.R. | 165/122 |
| 992399 | 5/1965 | United Kingdom | 165/54 |

*Primary Examiner*—Leonard R. Leo

*Attorney, Agent, or Firm*—Burns, Doane, Swecker & Mathis, L.L.P.

[57] ABSTRACT

An indoor air conditioner unit cools separate rooms through the use of a common fan. The fan comprises a rotary member positioned to physically separate first air inlet and outlet ports from second air inlet and outlet ports. The fan sucks-in air from both inlet ports and discharges air through both outlet ports.

3 Claims, 6 Drawing Sheets

INDOOR UNIT OF AIR CONDITIONER

BACKGROUND OF THE INVENTION

1. Field of the Invention

The present invention relates to an indoor unit of an air conditioner for cooling a room by supplying cold air in the room, and more particularly to such an indoor unit capable of cooling two room spaces.

2. Description of the Prior Art

Referring to FIG. 1, there is illustrated a conventional indoor air conditioner unit. As shown in FIG. 1, the indoor air conditioner includes a panel member 2 for forming an external appearance of the indoor unit. The panel member 2 is provided with an intake port 4 for sucking a room air and a discharge port 6 for discharging a cold air. The indoor unit further includes a filter member 3 disposed inwardly of the intake port 4 and adapted to filter foreign substances contained in the air sucked through the intake port 4, an evaporator 8 adapted to change the air passing through the filter member 3 into a cold air, and a fan member 9 adapted to supply the cold air from the evaporator in the room by a rotation thereof.

To form the appearance of the indoor unit, the panel member 2 is coupled with a case member 10 in which a duct member 5 is mounted. Beneath the evaporator 8, a drain member 7 is disposed which serves to outwardly drain a condensed water generated in the evaporator 8.

When a main switch (not shown) is switched to its ON state, the fan member 9 rotates. By the rotation of the fan member 9, room air enters the interior of the indoor unit through the intake port 4 of the panel member 2 and then passes through the filter member 3 and evaporator 8.

The air is changed into a cold air while passing through the evaporator 8. The cold air is guided by the duct member 5 to be discharged out of the discharge port 6 and then supplied in the room. By the supplied cold air, the room is cooled.

In the indoor unit of the conventional air conditioner, however, the room air is sucked only in one direction and the cold air is discharged only in one direction, as indicated by the arrow in FIG. 1.

Due to such a construction, where two room spaces are to be cooled, two indoor units are needed. Such a use of two indoor units results in an increased burden to consumers in terms of economy and an increase in consumed electric power.

Furthermore, excessive noise and vibration generated from the rotating fan members of the two indoor units give users an unpleasant feeling.

For solving such problems, there has been proposed a bidirectional intake-discharge type air conditioner. For example, such a bidirectional intake-discharge type air conditioner is disclosed in the Japanese Utility Model Publication No. Sho 62-27771 filed on Nov. 20, 1982 and published on Jul. 16, 1987. As shown in FIG. 2, that air conditioner includes a body 100 provided at its front and rear walls with a plurality of discharge ports 102 and 102'. A pair of fans 103 and 103' are disposed at opposite portions in the interior of body 100. A heat exchange coil 104 is inclinedly arranged in the interior of body 100 along the diagonal line of the body 100. A partition plate 105 is also arranged in the interior body 100 such that it crosses the heat exchange coil 104 in the form of X-shape.

Although the conventional bidirectional intake-discharge air conditioner has an effect capable of cooling two room spaces by one indoor unit, it involves various problems such as an increase in consumed electric power, an excessive generation of noise and vibration and thereby a degradation in quality.

SUMMARY OF THE INVENTION

Therefore, the present invention has been made in view of the above-mentioned problems encountered in the prior art and an object of the invention is to provide an indoor unit of an air conditioner capable of cooling two room spaces, reducing the consumed electric power and minimizing generation of noise and vibration.

In accordance with the present invention, this object can be accomplished by providing an indoor unit of an air conditioner for cooling a room, comprising: front and rear panel members respectively having intake ports and discharge ports for cooling two room spaces of the room; a pair of evaporators respectively disposed inwardly of the front and rear panel members and each adapted to change a room air sucked through the intake port of each corresponding one of the front and rear panel members into a cold air; and a fan member disposed in the interior of the indoor unit defined between the front and rear panel members and adapted to supply the cold air from the evaporators in the room through the discharge ports and suck the room air into the interior of the indoor unit by a rotation thereof.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
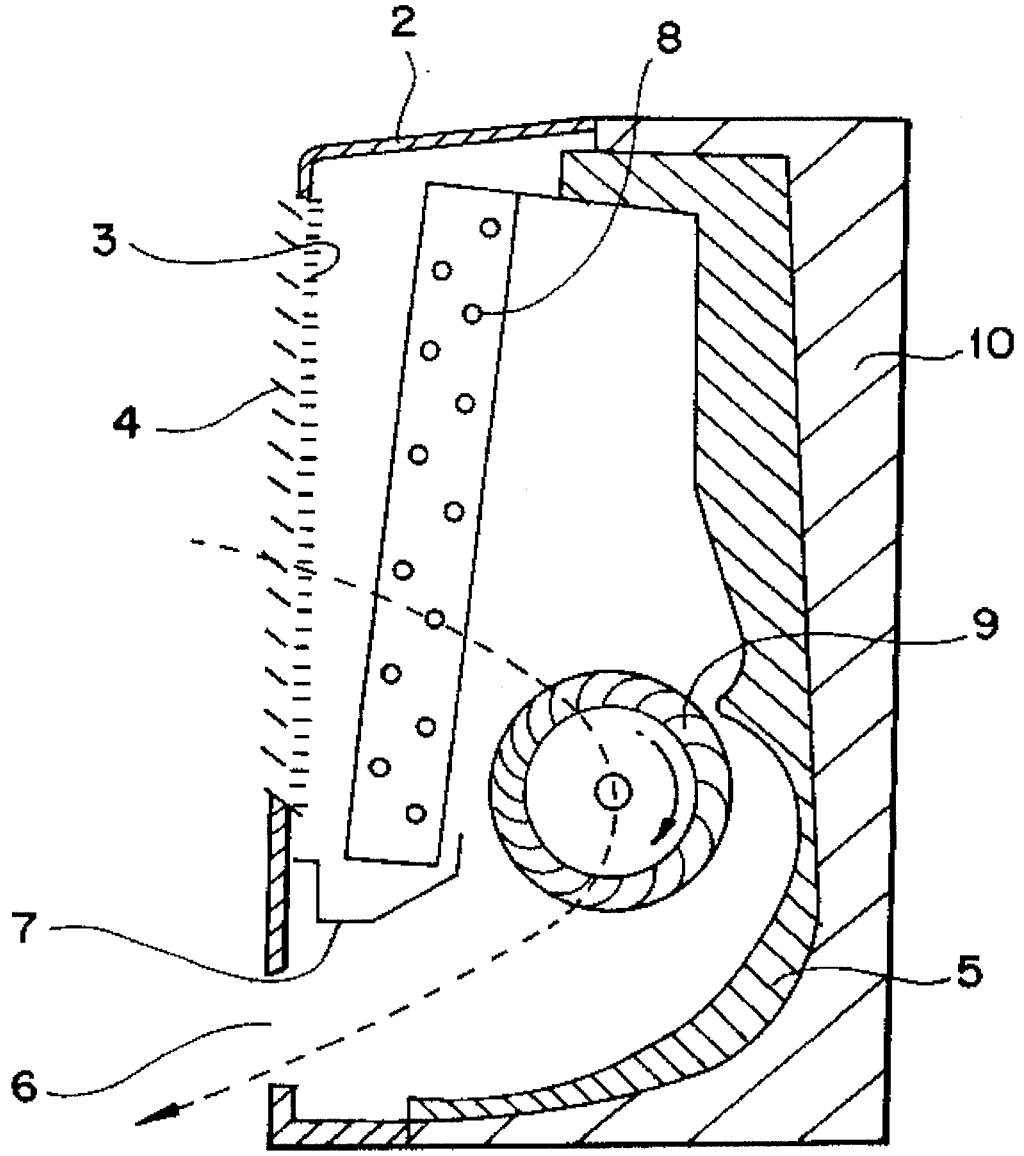
FIG. 1 PRIOR ART
FIG. 1 is a side sectional view schematically illustrating an indoor unit of a conventional air conditioner.
Figure 2:
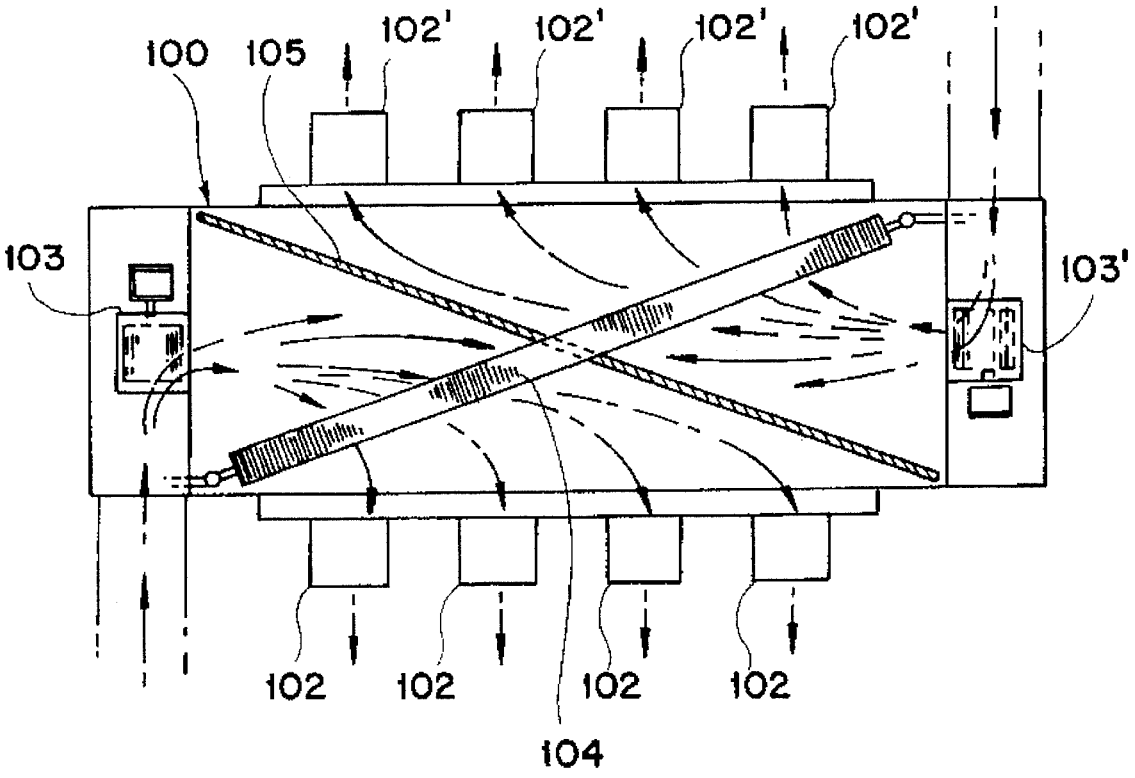
FIG. 2 PRIOR ART
FIG. 2 is a plan view illustrating another conventional air conditioner.
Figure 3:
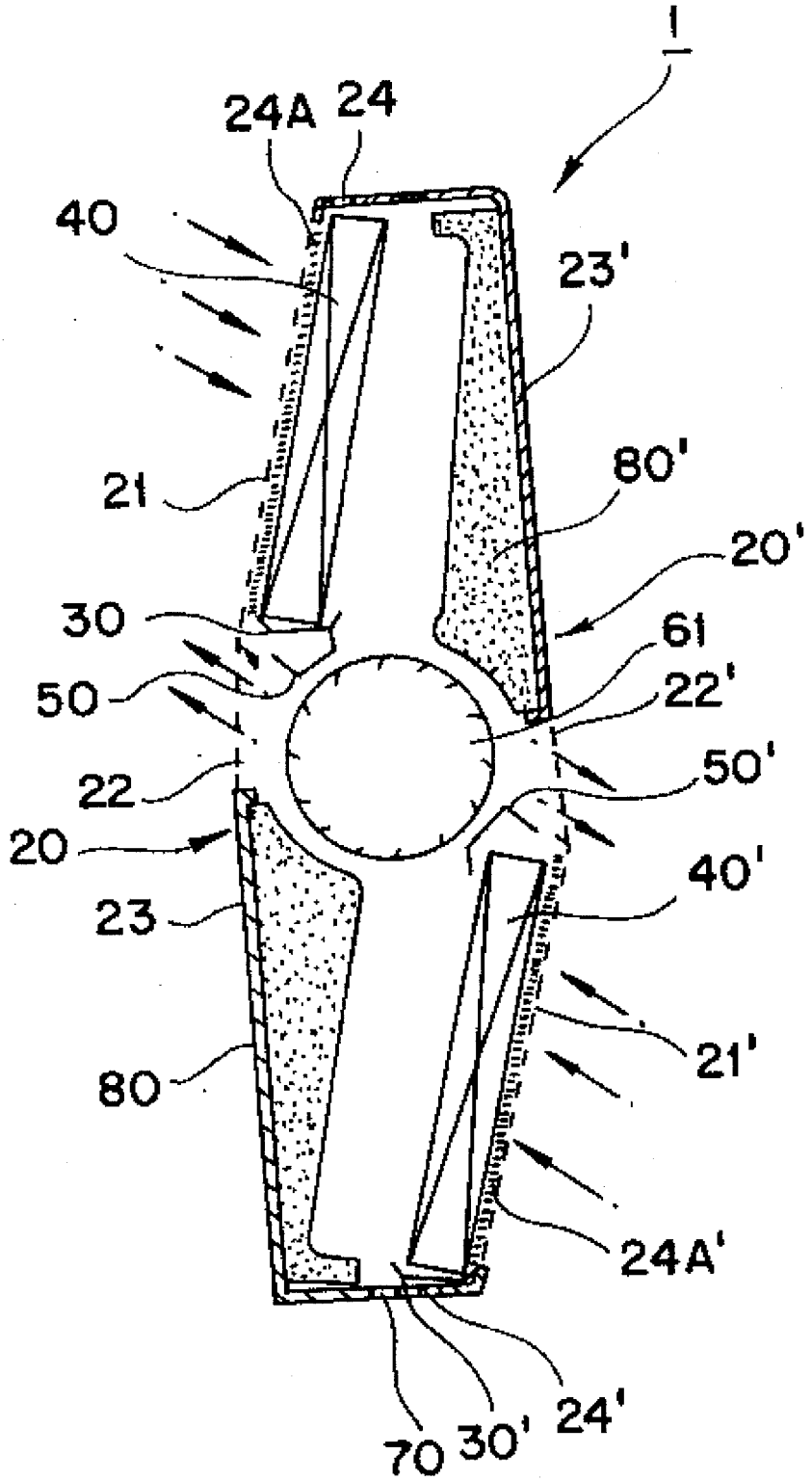
FIG. 3 is a side sectional view schematically illustrating an indoor unit of an air conditioner in accordance with a first embodiment of the present invention.
Figure 4:
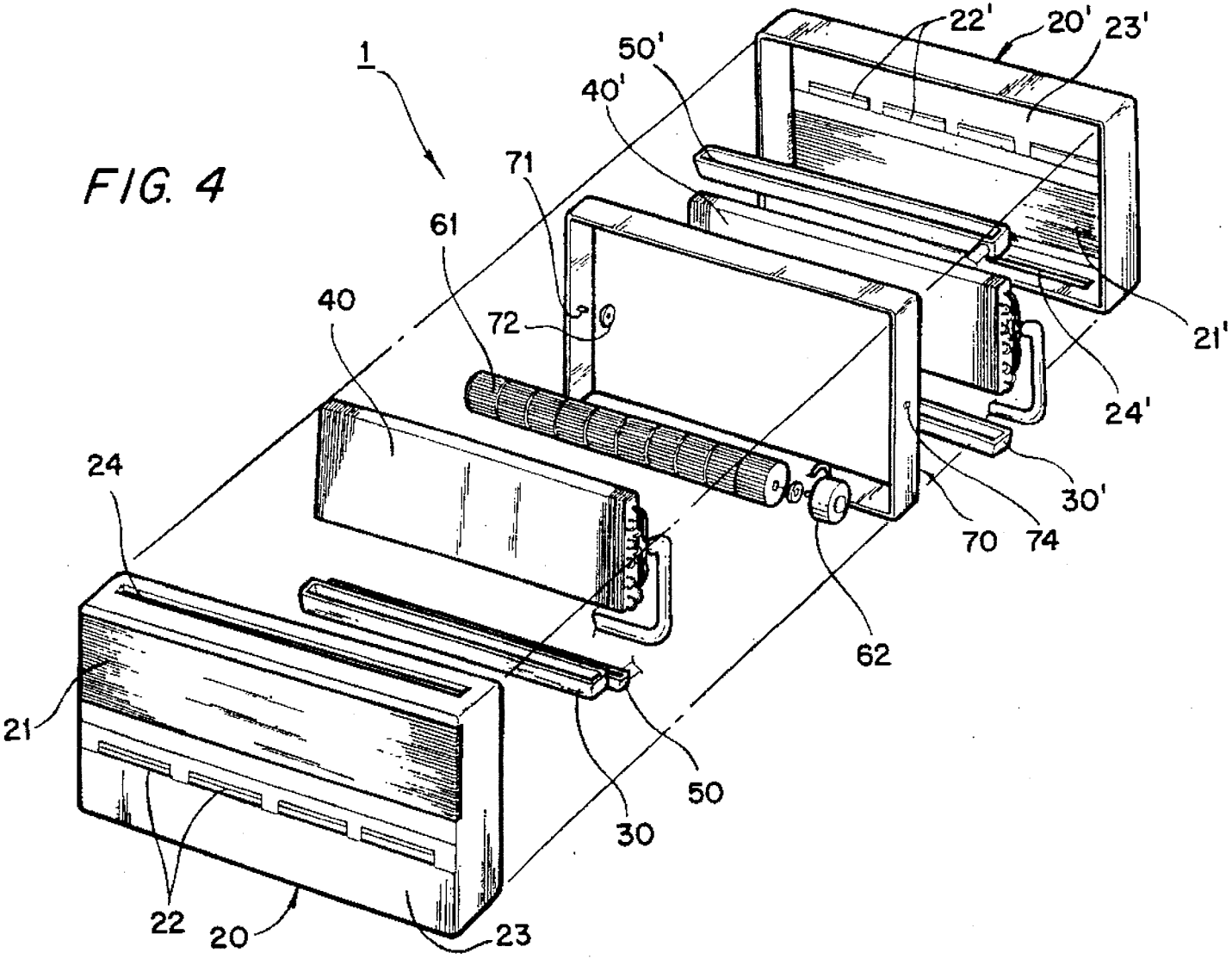
FIG. 4 is an exploded perspective view of the indoor unit in accordance with the first embodiment of the present invention.
Figure 5:
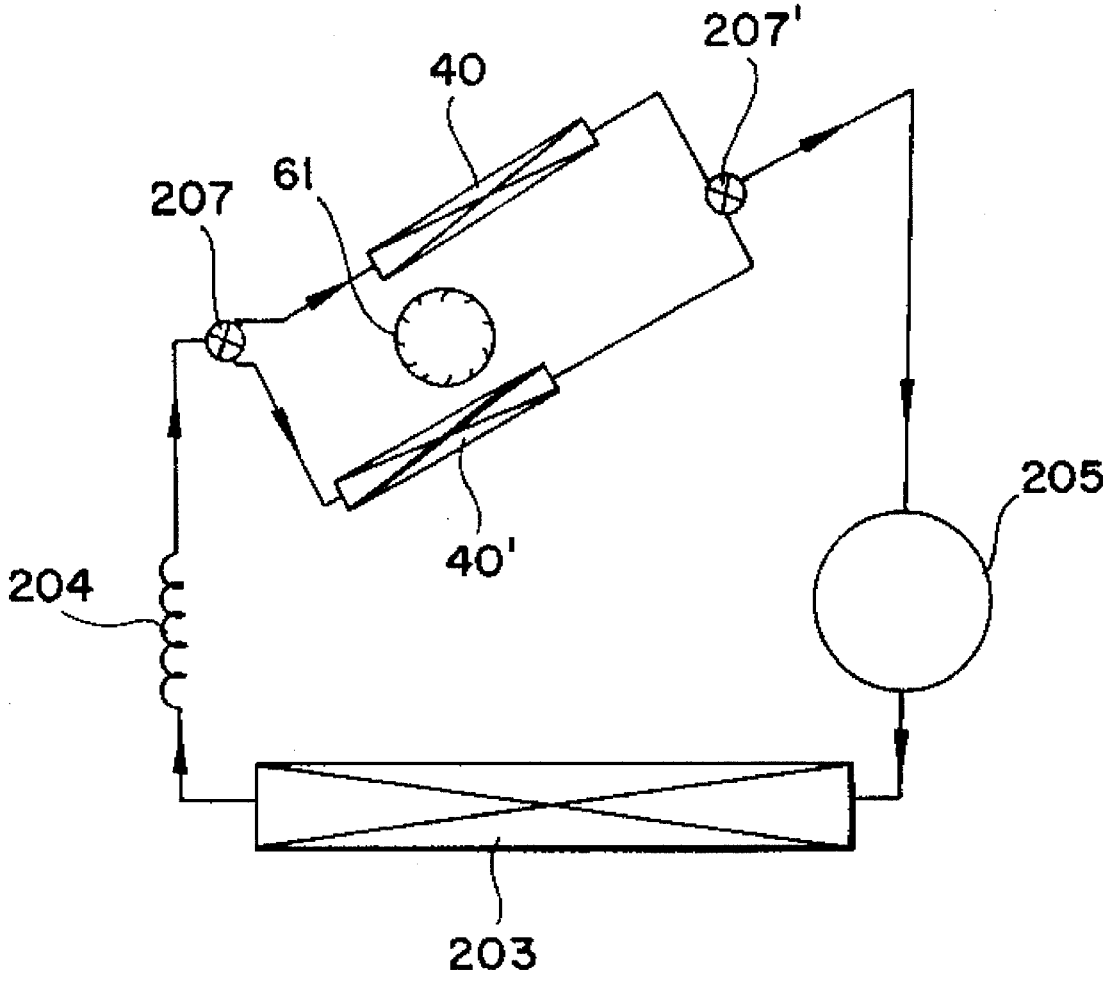
FIG. 5 is a diagram of a refrigerating cycle of the air conditioner in accordance with the first embodiment of the present invention.

In FIGS. 3 to 5, the reference numeral 20 denotes a front panel member forming an appearance of the indoor unit which is denoted by the reference numeral 1. The front panel member 20 has an intake port 21 for receiving room air, a discharge port 22 for discharging an air cooled in the indoor unit toward the room, and a duct supporting portion 23 for firmly supporting a duct member 80 adapted to guide the cold air toward the discharge port 22 and forming the appearance of the indoor unit 1.

The front panel member 20 is provided at its upper wall with a filter receiving portion 24 adapted to receive a filter member 24A which serves to filter foreign substances contained in the room air sucked through the intake port 21.

The discharge port 22 of the front panel member 20 is provided with blade members so as to adjust the direction of cold air discharged out of the discharge port 22 vertically and laterally.

Inwardly of the intake port 21 of the front panel member 20, an evaporator 40 is disposed which serves to exchange heat with the room air sucked through the intake port 21 and thereby change it into a cold air.

A drain member 30 is arranged beneath the evaporator 40. The drain member 30 serves to receive a water generated by a dehumidification of the evaporator 40 and outwardly drain the water. Beneath the drain member 30, a guide member 50 is fixedly mounted. The guide member 50 serves to guide cold air from the evaporator 40 and another evaporator to be described hereinafter toward the discharge port 22 so that the cold air can be easily discharged out of the discharge port 22.

Meanwhile, the reference numeral 61 denotes a fan member rotating by a drive force of a motor 62. The fan member 61 is disposed interiorly of the front panel member 20 and adapted to suck room air through the intake port 21 and another intake port to be described hereinafter and discharge cold air from the evaporator 40 and the other evaporator into the room through the discharge port 22 and another discharge port to be described hereinafter.

The reference numeral 70 denotes a rectangular support member (see FIG. 4) opened at its front and rear portions and adapted to partially receive the front panel member 20 and a rear panel member to be described hereinafter so as to support the panel members. The support member 70 also supports the fan member 61 and the motor 62.

At one side portion of the supporting member 70, a protruded shaft 71 is centrally provided which extends inwardly, as shown in FIG. 4. Around the protruded shaft 71, a bearing 72 is fitted to be received in a hole formed at one side portion of the fan member 61 and thereby support the fan member 61. At the other side portion of the supporting member 70, a support hole 74 is provided which serves to support the motor 62.

On the other hand, the reference numeral 20' denotes the rear panel member supported in rear of the support member 70 to form the appearance of the indoor unit 1. The rear panel member 20' has an intake port 21' for receiving room air, a discharge port 22' for discharging an air cooled in the indoor unit toward the room, and a duct supporting portion 23' for firmly supporting a duct member 80' adapted to guide the cold air toward the discharge port 22' and forming the appearance of the indoor unit 1.

The rear panel member 20' is provided at its lower wall with a filter receiving portion 24' adapted to receive a filter member 24A' which serves to filter foreign substances contained in the room air sucked through the intake port 21'.

The discharge port 22' of the rear panel member 20' is provided with blade members so as to adjust the direction of cold air discharged out of the discharge port 22' vertically and laterally.

The duct member 80' is fixedly mounted in the duct supporting portion 23' of the rear panel member 20' and adapted to guide a flow of air sucked through the intake port 21 of the front panel member 20 and cooled by the evaporator 40 toward both the discharge ports 22 and 22' respectively provided at the front and rear panel members 20 and 20'.

An evaporator 40' is disposed inwardly of the intake port 21' of the rear panel member 20'. The evaporator 40' serves to exchange heat with the room air sucked through the intake port 21' and thereby change it into a cold air.

A drain member 30' is arranged beneath the evaporator 40'. The drain member 30' serves to receive a water generated by a dehumidification of the evaporator 40' and drain the water out of the indoor unit 1. Above the evaporator 40', a guide member 50' is fixedly mounted. The guide member 50' serves to guide cold air from the evaporators 40 and 40' toward the discharge port 22' so that the cold air can be easily discharged out of the discharge port 22'.

It will be appreciated from viewing FIG. 3 that an imaginary plane containing the axis of the fan 61 and extending through respective midpoints of the outlets 22, 22' will divide the unit in half.

In FIG. 5 illustrating a refrigerating cycle employed in the air conditioner in accordance with the first embodiment of the present invention, the reference numeral 205 denotes a compressor adapted to compress a refrigerant emerging from the evaporators 40 and 40'. The reference numeral 203 denotes a condenser adapted to discharge heat from a refrigerant gas compressed in the compressor 205 and thereby change the refrigerant gas into a liquid refrigerant. The reference numeral 204 denotes a capillary tube adapted to drop the pressure of the liquid refrigerant produced in the condenser 203 and then feed the pressure-dropped liquid refrigerant to the evaporators 40 and 40'.

A three-directional valve 207 is arranged among the condenser 203 and the evaporators 40 and 40'. By means of the three-directional valve 207, the evaporators 40 and 40' receive equivalently the refrigerant pressure-dropped in the condenser 203.

A three-directional valve 207' is also arranged among the evaporators 40 and 40' and the compressor 205. At the three-directional valve 207', the refrigerant emerging from the evaporator 40 and the refrigerant emerging from the evaporator 40' join together and then flow toward the compressor 205.

Operation of the indoor unit of the air conditioner with the above-mentioned construction will now be described.

When a main switch not shown is switched to its ON state, the compressed refrigerant from the compressor 205 is fed to the condenser 203 in which the refrigerant of gas phase is changed into a liquid refrigerant.

Thereafter, the liquid refrigerant from the condenser 203 is fed to the capillary tube 204 and then dropped in pressure by the capillary tube 204. From the capillary tube 204, the refrigerant is distributed to both the evaporators 40 and 40'.

On the other hand, the motor 62 is activated by an electric power applied thereto, thereby causing the fan member 61 to rotate. By the rotation of the fan member 61, room air is sucked into the interior of the indoor unit 1 through the intake ports 21 and 21' respectively provided at the front and rear panel members 20 and 20', as shown in FIG. 3.

The air sucked through the intake ports 21 and 21' passes through the filter members 24A and 24A' respectively disposed inwardly of the intake ports 21 and 21'. By means of the filter members 24A and 24A', foreign substances contained in the room air are filtered and then fed to the evaporators 40 and 40'.

The air is changed into a cold air while passing through the evaporators 40 and 40'. The cold air is then guided by the duct members 80 and 80' and guide members 50 and 50' to be supplied in the room through the discharge ports 22 and 22' respectively provided at the front and rear panel members 20 and 20'. Thus, two room spaces can be cooled.

In other words, the room air sucked through the intake ports 21 and 21' is changed into cold air by the evaporators 40 and 40' and then supplied in the room through the discharge ports 22 and 22', thereby enabling two room spaces to be easily cooled.

Since two room spaces are cooled using one fan member 61, the consumed electric power is greatly reduced, while the generation of noise is minimized.

Figure 6:
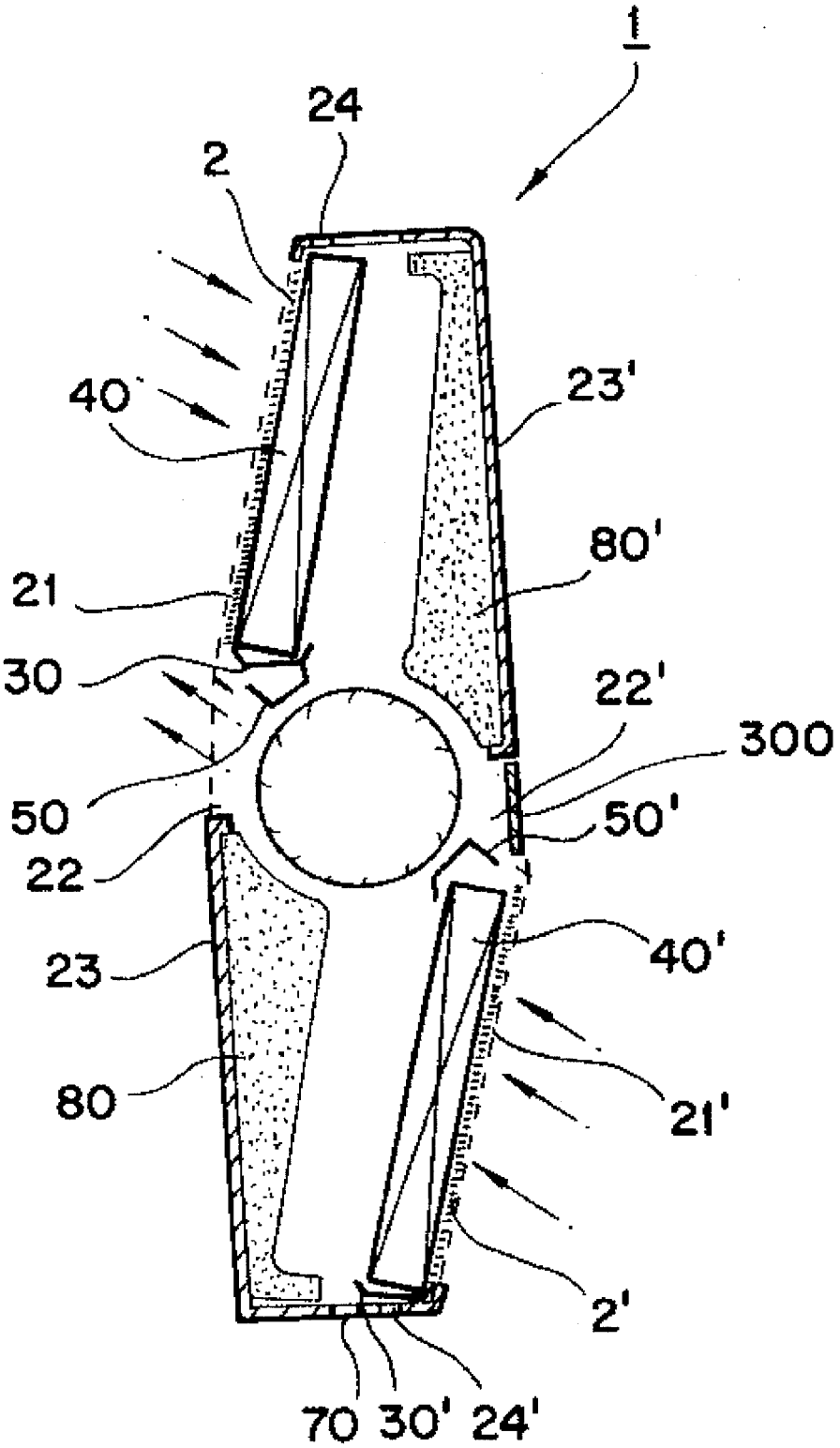
FIG. 6 is a side sectional view schematically illustrating an indoor unit of an air conditioner in accordance with a second embodiment of the present invention.

Referring to FIG. 6, there is illustrated an indoor unit of an air conditioner in accordance with a second embodiment of the present invention.

In accordance with the embodiment shown in FIG. 6, the discharge port 22' of rear panel member 20' is closed by a selectively closable member 300'. That is, the second embodiment is different from the first embodiment in that no cold air is discharged out of the discharge port 22', even though room air is sucked into the interior of indoor unit through the intake port 21' of rear panel member 20'.

In other words, one of two room spaces is at a cooling state, while the other room space is at a dehumidifying state.

As apparent from the above description, the present invention provides an indoor air conditioner unit capable of cooling two room spaces or cooling one of the two room spaces while dehumidifying the other room space by using a single fan member. Accordingly, it is possible to greatly reduced the consumed electric power and minimize the generation of noise and vibration. This achieves an improvement in quality of the air conditioner.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An indoor air conditioner unit for cooling separate first and second spaces, comprising:

a housing including front and rear panels disposed on opposite sides of said housing, said front panel forming a first air inlet port and a first air outlet port for cooling said first space, said rear panel forming a second air inlet port and a second air outlet port for cooling said second space;

first and second spaced apart evaporators disposed in said housing and arranged to cool air sucked in through said first and second air inlet ports, respectively; and a fan member disposed in said housing and positioned to physically separate said first inlet and outlet ports from said second inlet and outlet ports, said fan member arranged to suck-in air through both of said first and second inlet ports and discharge air through both of said first and second outlet ports, said fan member comprising a rotor rotatable about an axis extending substantially parallel to said front and rear panels, wherein an imaginary plane containing said axis and extending through respective midpoints of said first and second outlet ports, divides said unit substantially in half.

2. The indoor air conditioner unit according to claim 1, wherein said housing further includes a support member disposed between said front and rear panels for supporting said front and rear panels and said fan member.

3. The indoor air conditioner unit according to claim 1, wherein one of said first and second outlet ports is closable.

* * * * *